US010697725B2

(12) United States Patent
Millar et al.

(10) Patent No.: US 10,697,725 B2
(45) Date of Patent: Jun. 30, 2020

(54) TOOL FOR FIREARM SELECTOR REMOVAL AND INSTALLATION AND METHOD OF FIREARM SELECTOR REMOVAL AND INSTALLATION

(71) Applicant: COLT'S MANUFACTURING IP HOLDING COMPANY LLC, West Hartford, CT (US)

(72) Inventors: Scott Marshall Millar, Canton, CT (US); Michael Richard Schroder, Broad Brook, CT (US); Donald Dean Senchuk, New Britain, CT (US); Arthur Felix Daigle, Plymouth, CT (US)

(73) Assignee: COLT'S MANUFACTURING IP HOLDING COMPANY LLC, West Hartford, CT (US)

( * ) Notice: Subject to any disclaimer, the term of this patent is extended or adjusted under 35 U.S.C. 154(b) by 0 days.

(21) Appl. No.: 16/549,768

(22) Filed: Aug. 23, 2019

(65) Prior Publication Data

US 2020/0064097 A1 Feb. 27, 2020

Related U.S. Application Data

(60) Provisional application No. 62/722,802, filed on Aug. 24, 2018.

(51) Int. Cl.
*F41A 19/46* (2006.01)
*F41A 19/44* (2006.01)

(52) U.S. Cl.
CPC ..... *F41A 19/46* (2013.01); *F41A 19/44* (2013.01)

(58) Field of Classification Search
CPC ..... F41A 35/00; F41A 19/45; F41A 19/44; F41A 11/00
USPC ..... 42/108; 89/132
See application file for complete search history.

(56) References Cited

U.S. PATENT DOCUMENTS

| | | | | |
|---|---|---|---|---|
| 4,433,610 | A | 2/1984 | Tatro | |
| 4,837,963 | A * | 6/1989 | Slappey, Jr. | B25B 27/02 42/90 |
| 5,760,328 | A | 6/1998 | Robbins | |
| 8,850,738 | B2 * | 10/2014 | Silver | F41A 17/44 42/1.05 |
| 10,126,081 | B1 * | 11/2018 | Geissele | F41A 17/46 |

(Continued)

*Primary Examiner* — Joshua E Freeman
(74) *Attorney, Agent, or Firm* — Cantor Colburn LLP

(57) ABSTRACT

Disclosed herein is a method and apparatus for replacing a selector switch of lower receiver of a firearm, the method including the steps of: removing an ancillary portion of the selector switch; inserting a sear spring and sear deflector block into the lower receiver such that a hook portion and an end portion of the sear spring engage a sear and a portion of a sear spring to cause the sear and the portion of a sear spring to be disengaged from the selector switch; inserting a detent deflector button into a side of the lower receiver such a spring biased detent is depressed and the selector switch extends from an opposite side of the lower receiver; removing the selector switch; inserting a new selector switch into the opposite side of the lower receiver such that the detent deflector button is dislodged from the side of the lower receiver; removing the sear spring and sear deflector block; and securing the removing the ancillary portion or a new ancillary portion to the new selector switch.

3 Claims, 19 Drawing Sheets

(56) References Cited

U.S. PATENT DOCUMENTS

| | | | | |
|---|---|---|---|---|
| 2008/0190006 | A1* | 8/2008 | Jenkins | B25B 27/04 42/90 |
| 2008/0302235 | A1* | 12/2008 | Lauck | F41A 17/46 89/132 |
| 2014/0338523 | A1* | 11/2014 | Daley, Jr. | F41A 19/46 89/149 |
| 2015/0308768 | A1* | 10/2015 | Mills | F41A 11/04 42/75.03 |
| 2016/0187090 | A1* | 6/2016 | Mather | F41A 17/46 42/70.06 |
| 2017/0176122 | A1* | 6/2017 | Underwood | F41A 19/46 |
| 2018/0100712 | A1* | 4/2018 | Tompkins | F41A 19/15 |
| 2019/0186855 | A1* | 6/2019 | Carr | F41A 11/02 |
| 2019/0195587 | A1* | 6/2019 | Thomele | F41A 17/60 |

* cited by examiner

TOOL FOR FIREARM SELECTOR REMOVAL AND INSTALLATION AND METHOD OF FIREARM SELECTOR REMOVAL AND INSTALLATION

CROSS REFERENCE TO RELATED APPLICATIONS

This application claims priority to U.S. Provisional Patent Application No. 62/722,802 filed on Aug. 24, 2018, the entire contents of which are incorporated herein by reference thereto.

BACKGROUND

The disclosed embodiments relate to a tool and method for removal of installation of a firearm selector.

Automatic and semi-automatic firearms may be provided with a fire control selector enabling the user to switch between modes of fire, such as for example, "SAFE", semi-automatic, burst and/or automatic. For example, U.S. Pat. Nos. 5,760,328 and 4,433,610, the contents of which are incorporated herein by reference in their entirety, disclose M-4 type firearms, each having a fire control selector protruding from the receiver of the firearm. Here, the user rotates the fire control selector with a thumb or other finger(s) to switch between firearm modes of operation.

Other fire control selectors may be operated from either side and are referred to as ambidextrous fire control selectors or selector switches or "ambi" selector switches. In order to remove and replace any of the aforementioned selectors or selector switches typically numerous portions of the firearm must be disassembled in order to complete the desired task. This takes time and effort in order to change the fire control selectors or selector switches. Accordingly, there is a desire to provide an improved method and apparatus for changing the fire control selectors or selector switches of a firearm.

SUMMARY OF THE EMBODIMENTS

Disclosed herein is a method of replacing a selector switch of lower receiver of a firearm, the method including the steps of: removing an ancillary portion of the selector switch; inserting a sear spring and sear deflector block into the lower receiver such that a hook portion and an end portion of the sear spring engage a sear and a portion of a sear spring to cause the sear and the portion of a sear spring to be disengaged from the selector switch; inserting a detent deflector button into a side of the lower receiver such a spring biased detent is depressed and the selector switch extends from an opposite side of the lower receiver; removing the selector switch; inserting a new selector switch into the opposite side of the lower receiver such that the detent deflector button is dislodged from the side of the lower receiver; removing the sear spring and sear deflector block; and securing the ancillary portion or a new ancillary portion to the new selector switch.

Also disclosed herein is a kit for replacing a selector switch of a lower receiver of a firearm, the kit including: a sear spring and sear deflector block having a hook portion for engaging a portion of a sear spring when the sear spring and sear deflector block is secured to the lower receiver and an end portion for engaging a sear of the lower receiver when the sear spring and sear deflector block is secured to the lower receiver, the sear spring and sear deflector block further comprising a protrusion for engaging a buffer spring of the lower receiver when the sear spring and sear deflector block is secured to the lower receiver; and a detent deflector button for depressing a detent of the lower receiver when detent deflector button is inserted into an opening of the lower receiver configured to receive the selector switch.

Also disclosed herein is a sear spring and sear deflector block for replacing a selector switch of a lower receiver of a firearm, the sear spring and sear deflector block having a hook portion for engaging a portion of a sear spring when the sear spring and sear deflector block is secured to the lower receiver and an end portion for engaging a sear of the lower receiver when the sear spring and sear deflector block is secured to the lower receiver, the sear spring and sear deflector block further comprising a protrusion for engaging a buffer spring of the lower receiver when the sear spring and sear deflector block is secured to the lower receiver.

Also disclosed herein is a detent deflector button for replacing a selector switch of a lower receiver of a firearm, the detent deflector button including: a detent deflector button for depressing a detent of the lower receiver when detent deflector button is inserted into an opening of the lower receiver configured to receive the selector switch.

BRIEF DESCRIPTION OF THE DRAWINGS

The foregoing aspects and other features of various embodiments of the present disclosure are explained in the following description, taken in connection with the accompanying drawings, wherein.

DETAILED DESCRIPTION OF THE EXEMPLARY EMBODIMENT(S)

Figure 1A:
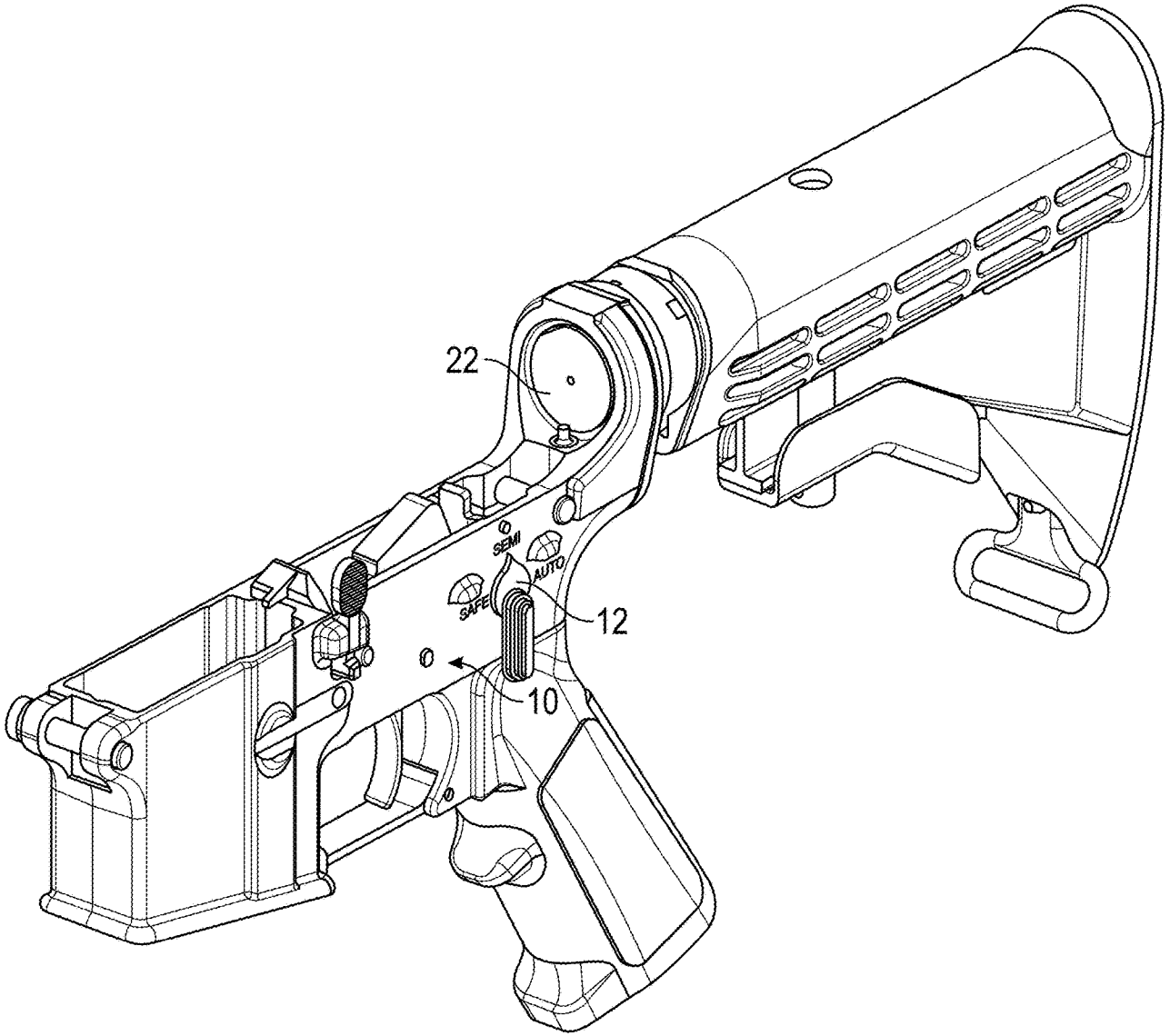
FIGS. 1A and 1B are perspective views of a lower receiver of a firearm.
Figure 1B:
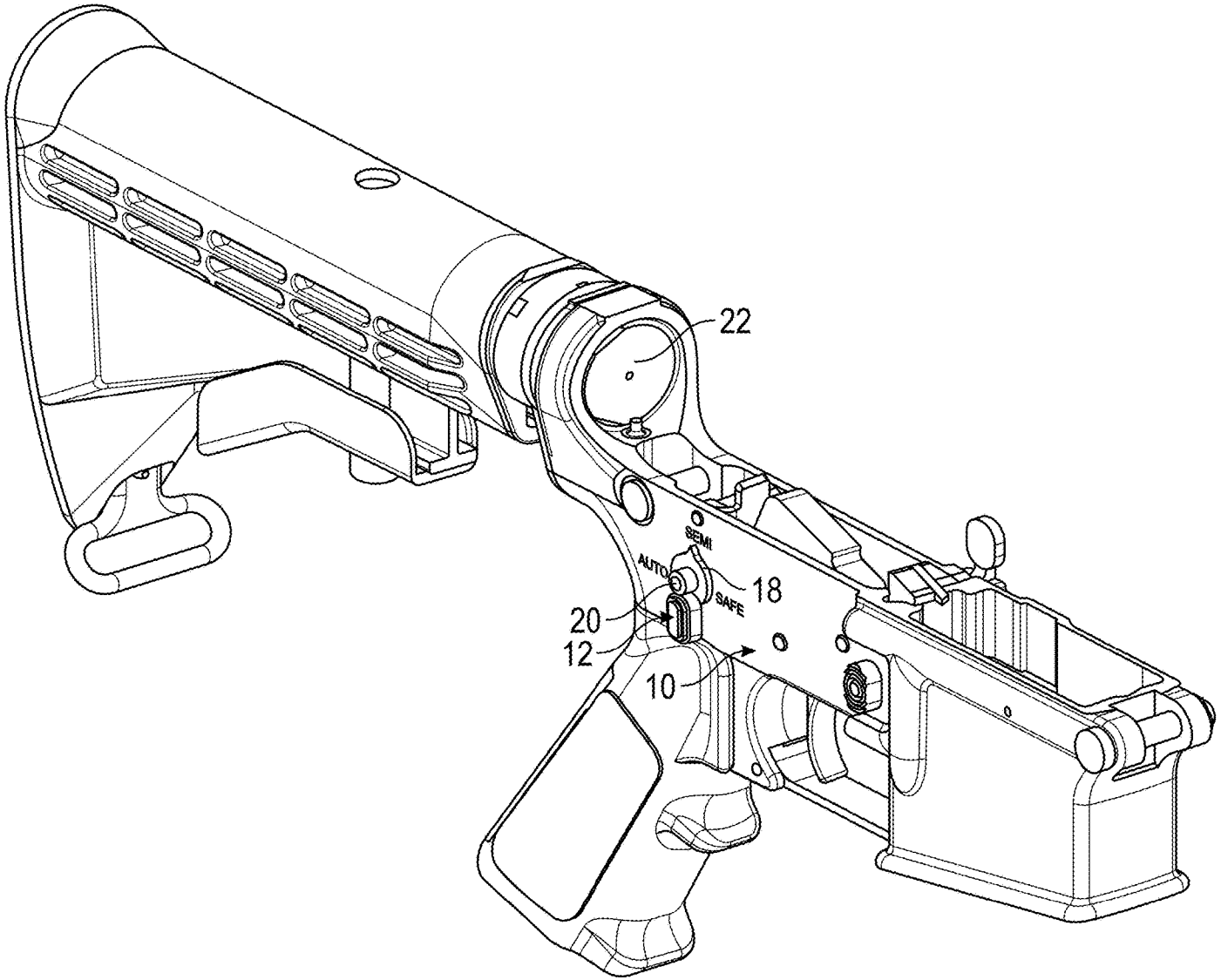

Referring now to at least FIGS. 1A and 1B, there is shown, a lower receiver 10 of a semi-automatic firearm capable semi-automatic fire incorporating features in accordance with an exemplary embodiment of the present invention. Although the present invention will be described with reference to the embodiments shown in the drawings, it should be understood that the present invention can be embodied in many alternate forms of embodiments. In addition, any suitable size, shape or type of elements or materials could be used.

In the exemplary embodiment shown in FIGS. 1A and 1B the lower receiver 10 can be used rifles being known as the family of rifles developed by Eugine Stoner, for example, such as an M-4™, M-16 or AR15 type firearms for example purposes. In alternative embodiments, the firearm may be of any other suitable type. The firearm incorporates a firing mechanism capable of operation at least in a semi-automatic mode. The firing mechanism may also be placed in a "SAFE" mode and a fully automatic of "AUTO" mode. The firearm mechanism has a mode or fire control selector or selector or selector switch 12 allowing a user to select the mode of operation of the firing mechanism. As mentioned above, the selector switch 12 may be operated from either side of the firearm and hence the firearm selector is ambidextrous or an "ambi" selector.

As mentioned above it is desirable to provide an improved method and apparatus for changing the fire control selectors or selector switches of a firearm. In accordance with the present disclosure, a kit for removing and replacing the fire control selectors or selector switches of a firearm is provided. The kit includes a sear spring and sear deflector block 14 and detent deflector button 16.

Referring now to the FIGS. removal of the fire control selectors or selector switches 12 of a firearm with the aforementioned kit is illustrated and described.

Figure 2:
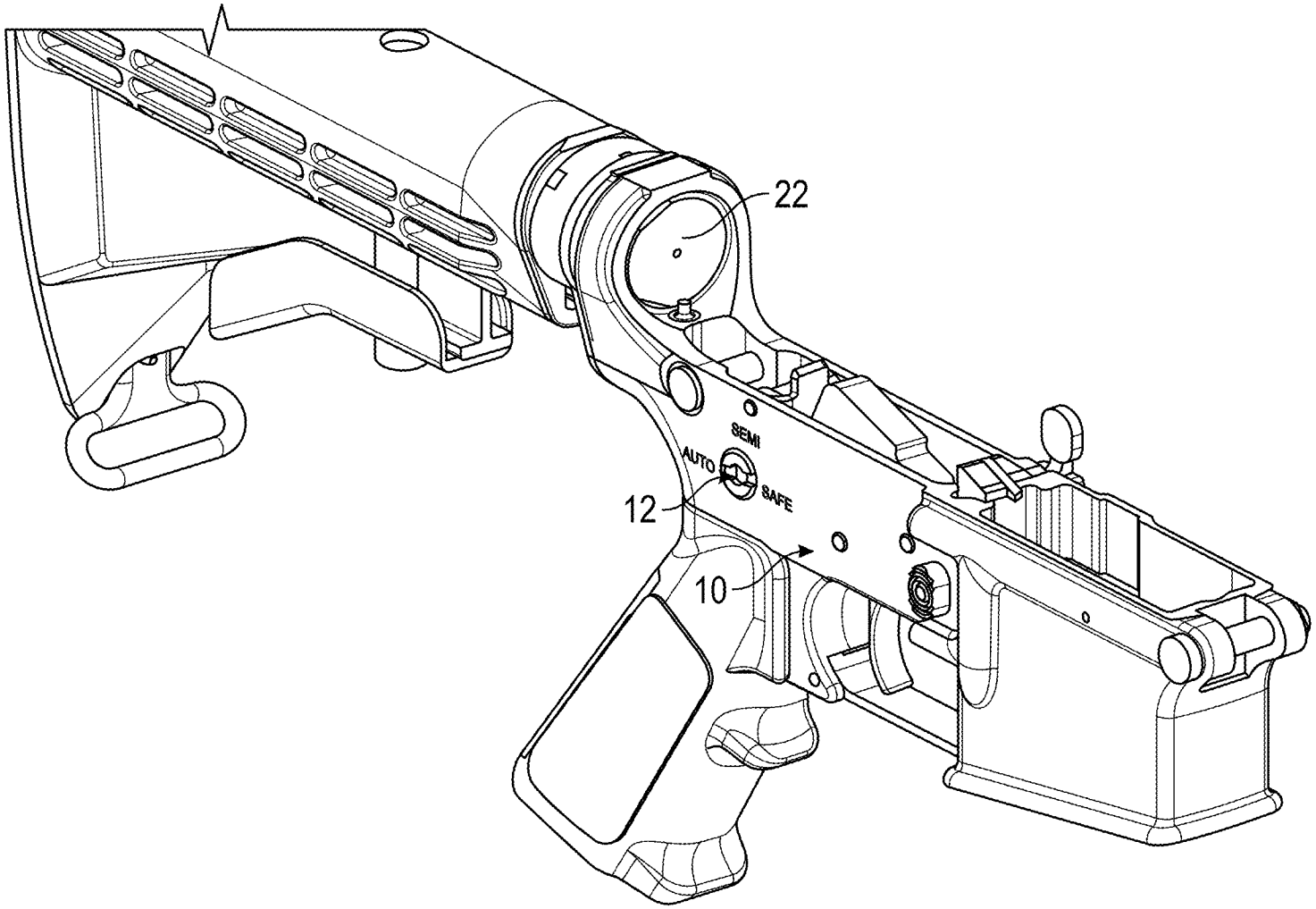
FIG. 2 is a perspective view of a lower receiver of a firearm with a portion of a selector switch removed.

In FIG. 2 a portion or ancillary lever 18 of an ambidextrous or an "ambi" selector switch 12 is removed by removing a screw 20 holding it to other portions of the selector switch.

Figure 3:
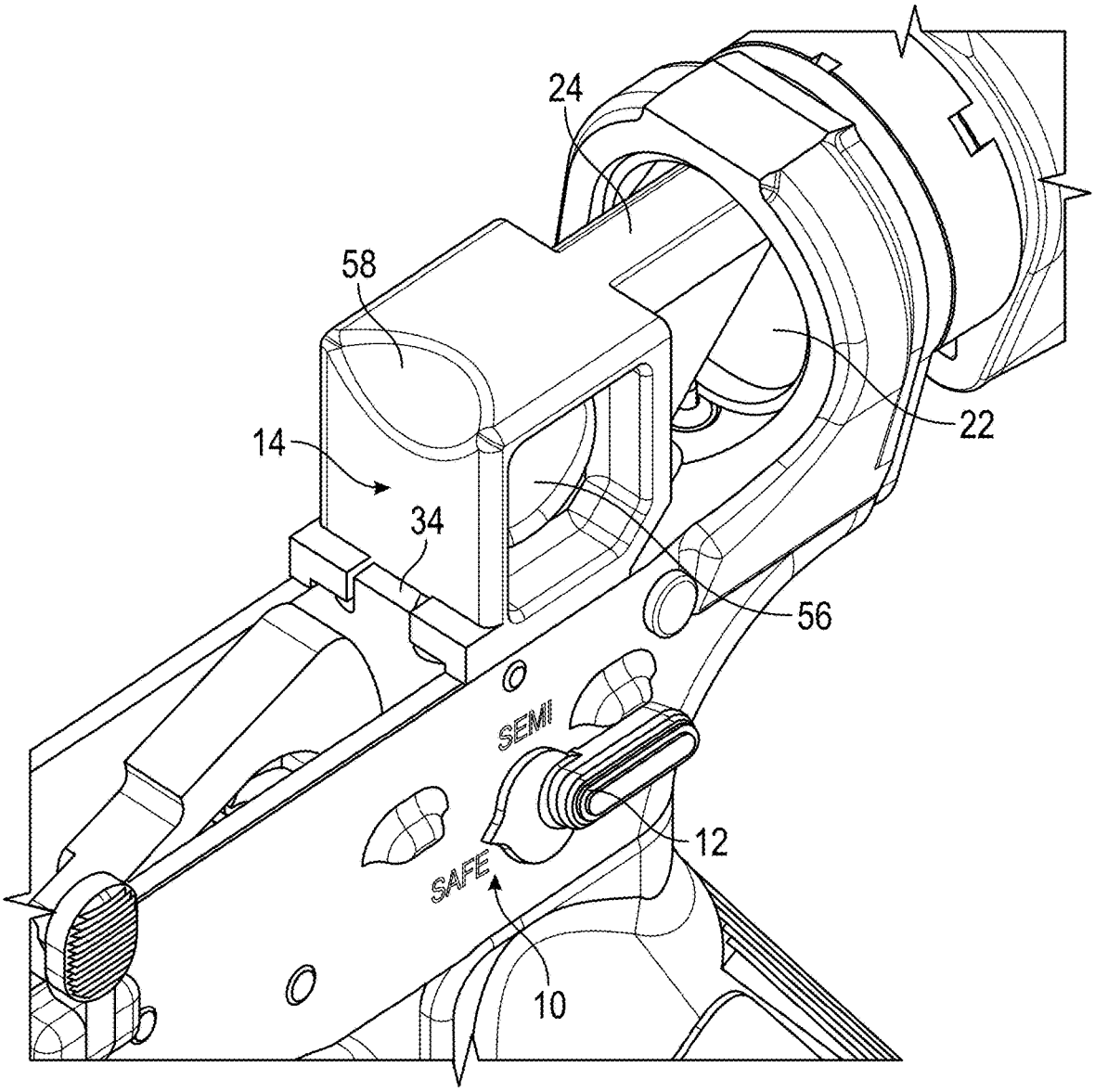
FIG. 3 is a perspective view of a lower receiver of a firearm with a sear spring and sear deflector block installed therein.
Figure 4:
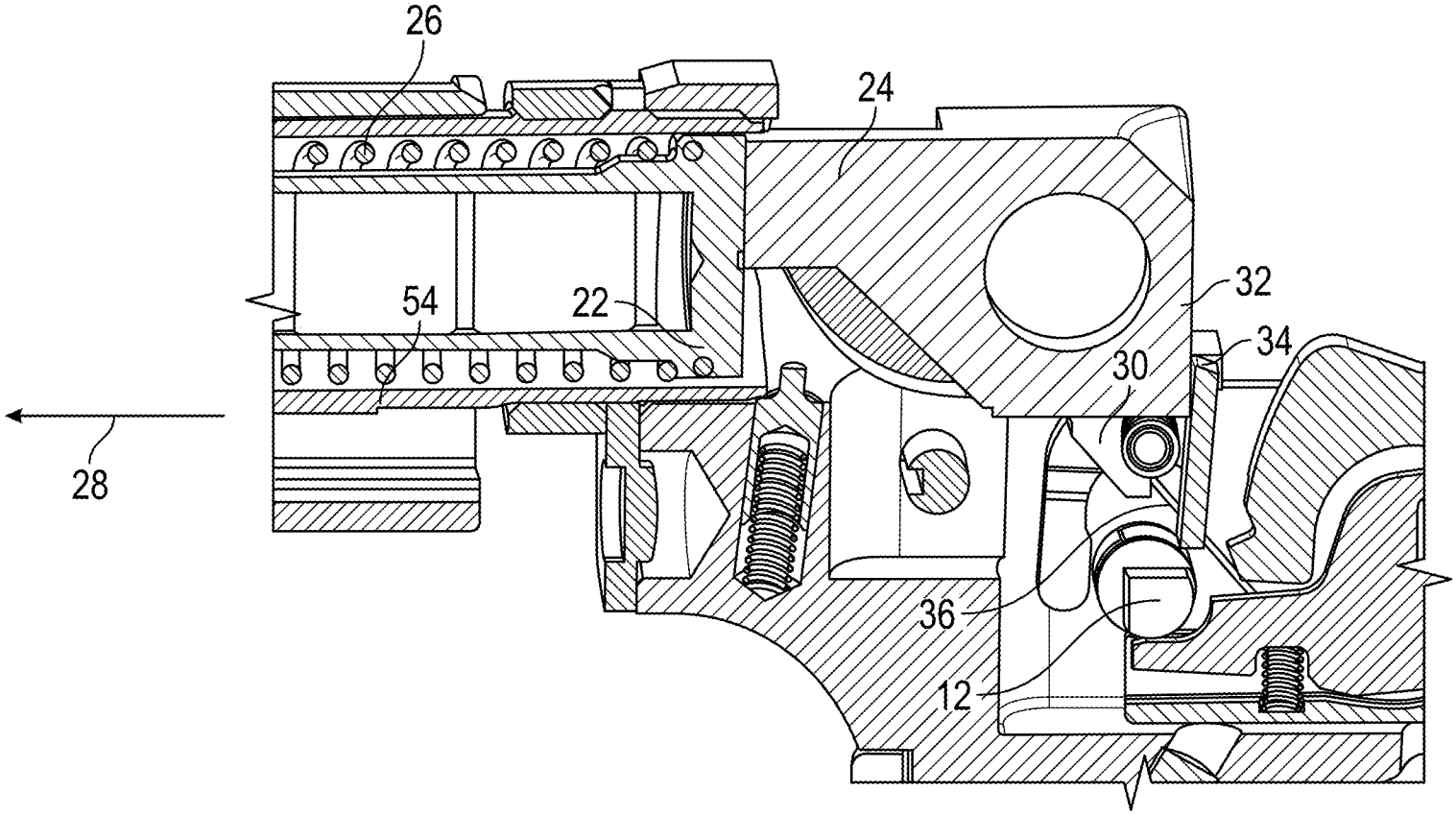
FIG. 4 is a cross-sectional view of a lower receiver of a firearm with a sear spring and sear deflector block installed therein.

Then and as illustrated in at least FIGS. 3 and 4, the sear spring and sear deflector block 14 installed therein. During this installation, the sear spring and sear deflector block 14 contacts a buffer 22 with a protrusion 24 of the sear spring and sear deflector block 14 to compress a buffer spring 26 in the direction of arrow 28 such that buffer spring 26 provides a biasing force to the sear spring and sear deflector block 14 in a direction opposite to arrow 28. This allows a hook portion 30 and an end portion 32 of the sear spring and sear deflector block 14 to engage a sear 34 and a portion 36 of a sear spring such that biasing force of the buffer spring 26 causes the sear 34 and a portion 36 of a sear spring to be disengaged from the selector switch 12 as the sear spring and sear deflector block 14 moves in a direction opposite to arrow 28.

Figure 5:
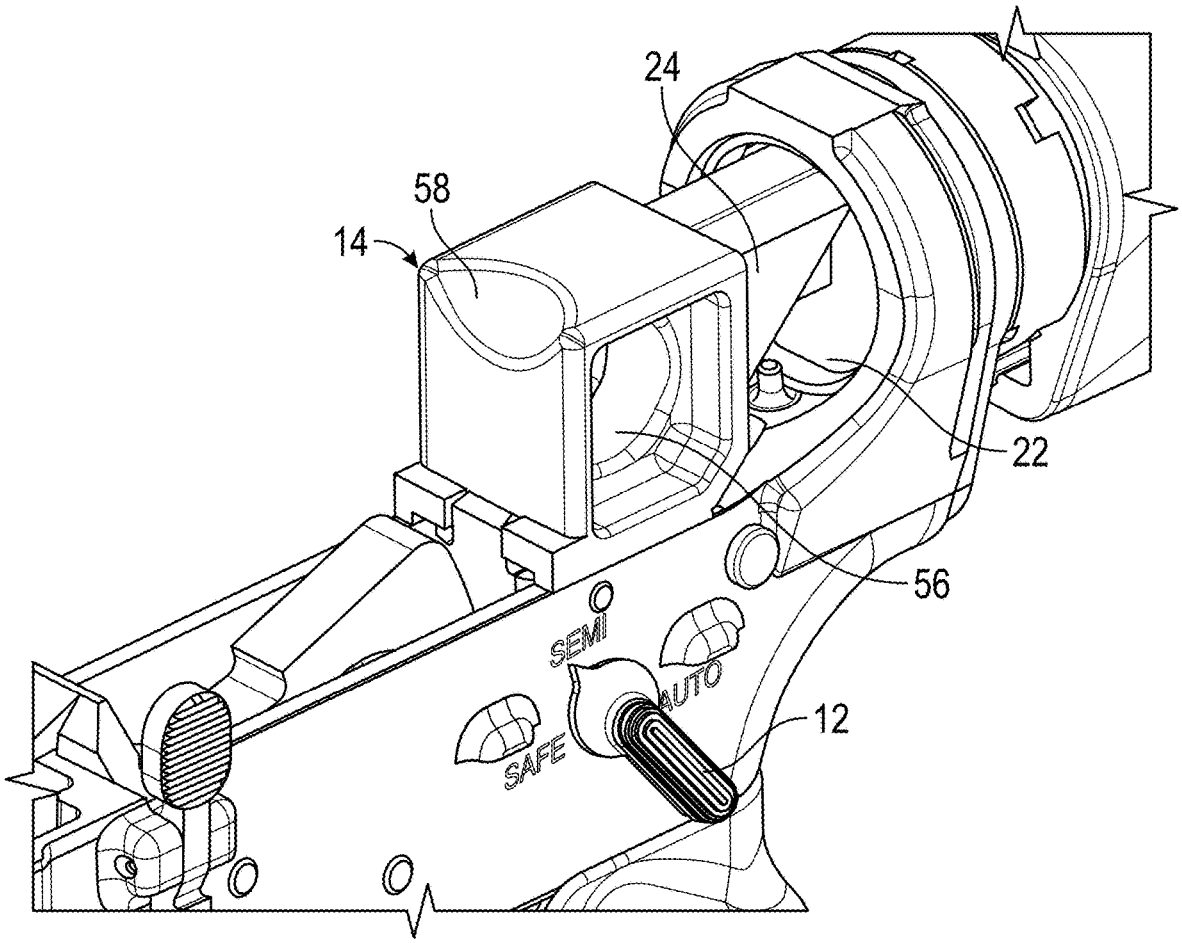
FIG. 5 is a perspective view of a lower receiver of a firearm with a sear spring and sear deflector block installed therein and the selector switch turned approximately to 45 degrees between safe and semi.
Figure 6:
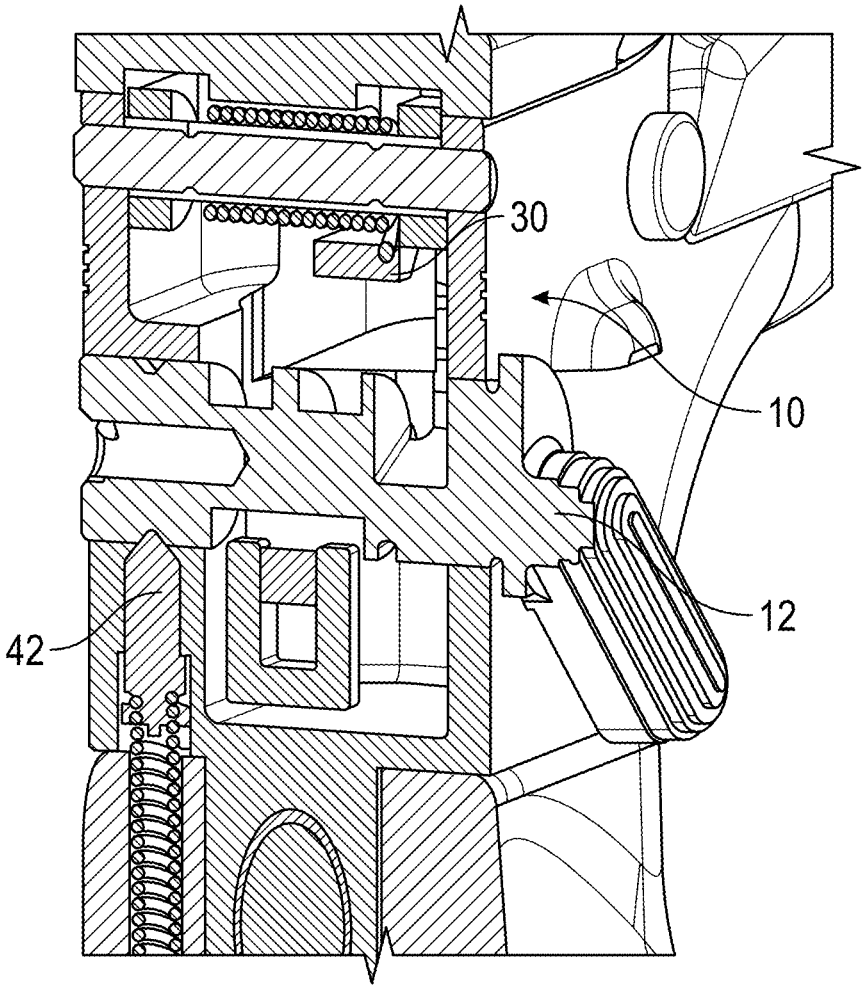
FIG. 6 is a cross-sectional view of a lower receiver of a firearm with a sear spring and sear deflector block installed therein and the selector switch turned approximately to 45 degrees between safe and semi.
Figure 7:
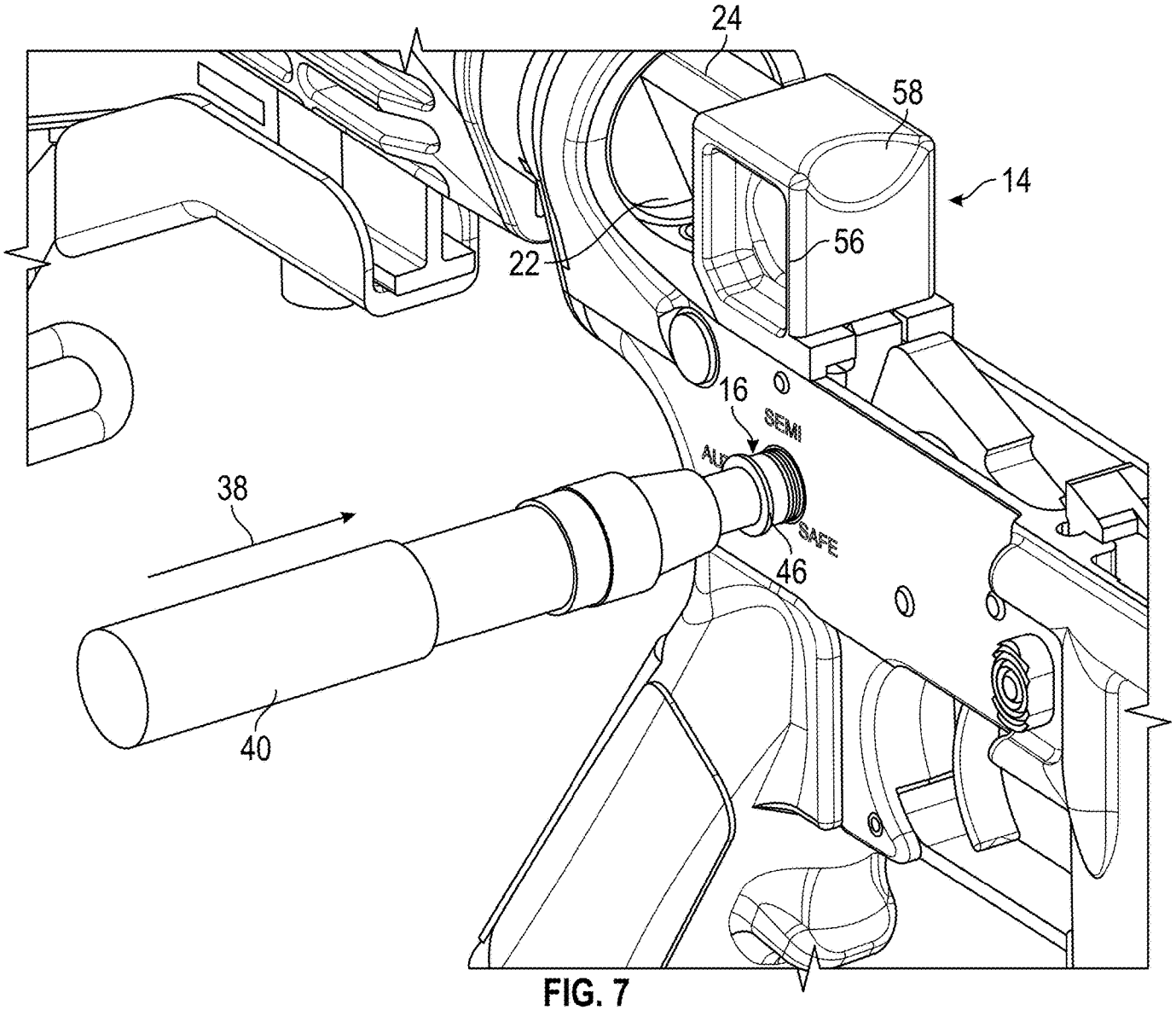
FIG. 7 is a perspective view of a lower receiver of a firearm with a sear spring and sear deflector block installed therein and a detent deflector button being inserted into the lower received to remove the selector switch.
Figure 8:
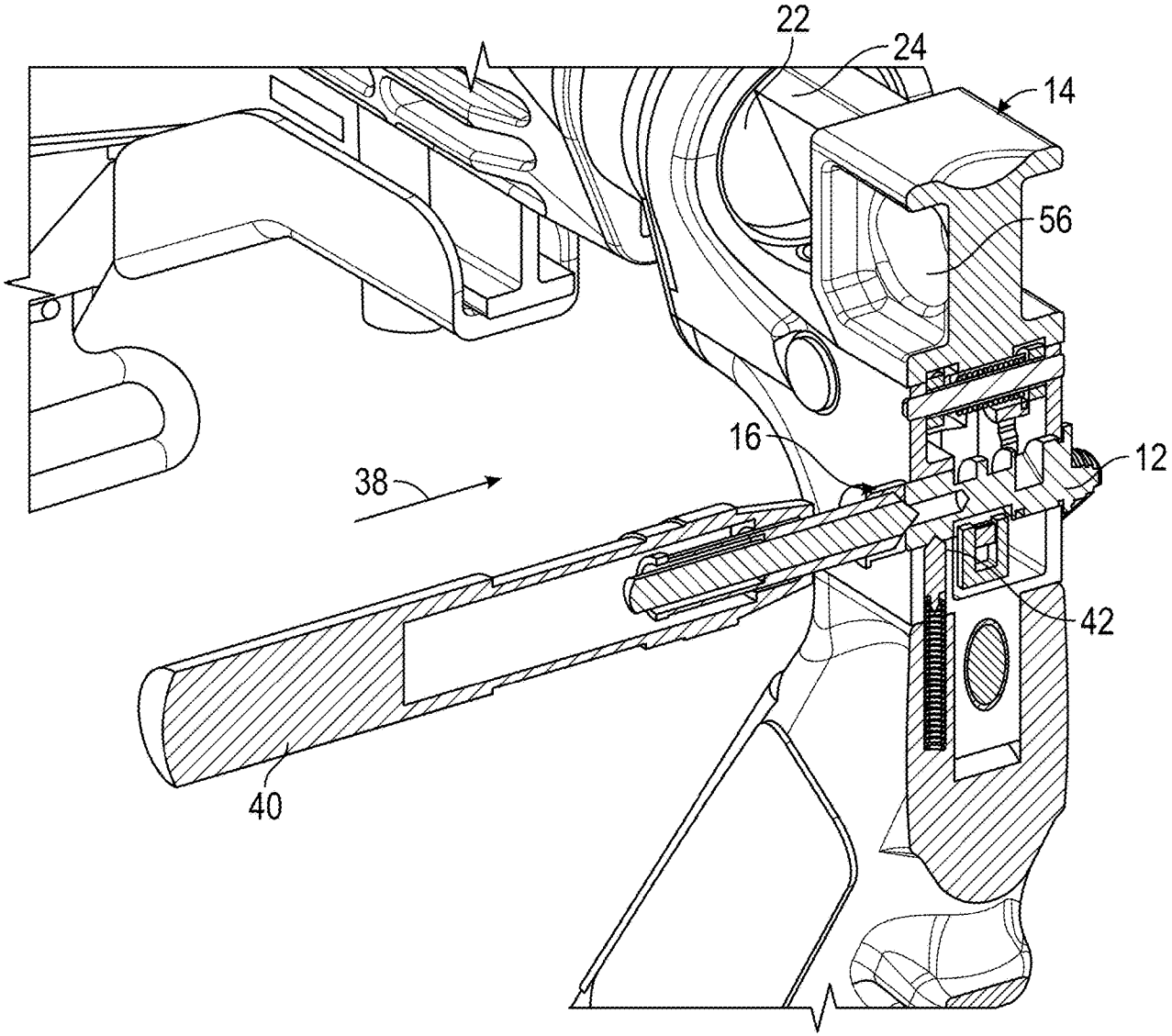
FIG. 8 is a cross-sectional view of a lower receiver of a firearm with a sear spring and sear deflector block installed therein and a detent deflector button being inserted into the lower received to remove the selector switch.
Figure 9:
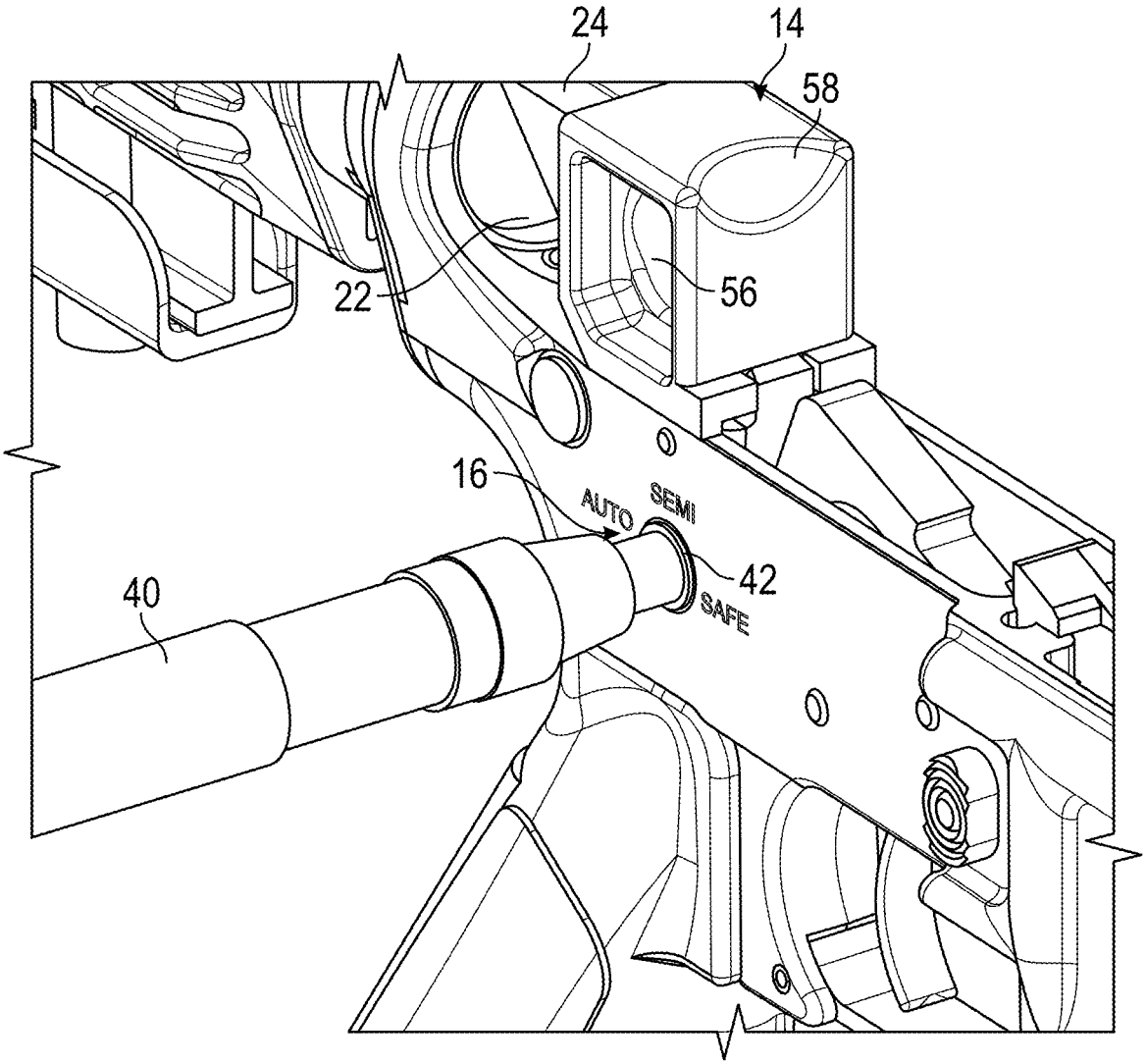
FIG. 9 is a perspective view of a lower receiver of a firearm with a sear spring and sear deflector block installed therein and a detent deflector button fully inserted into the lower received to remove the selector switch.
Figure 10:
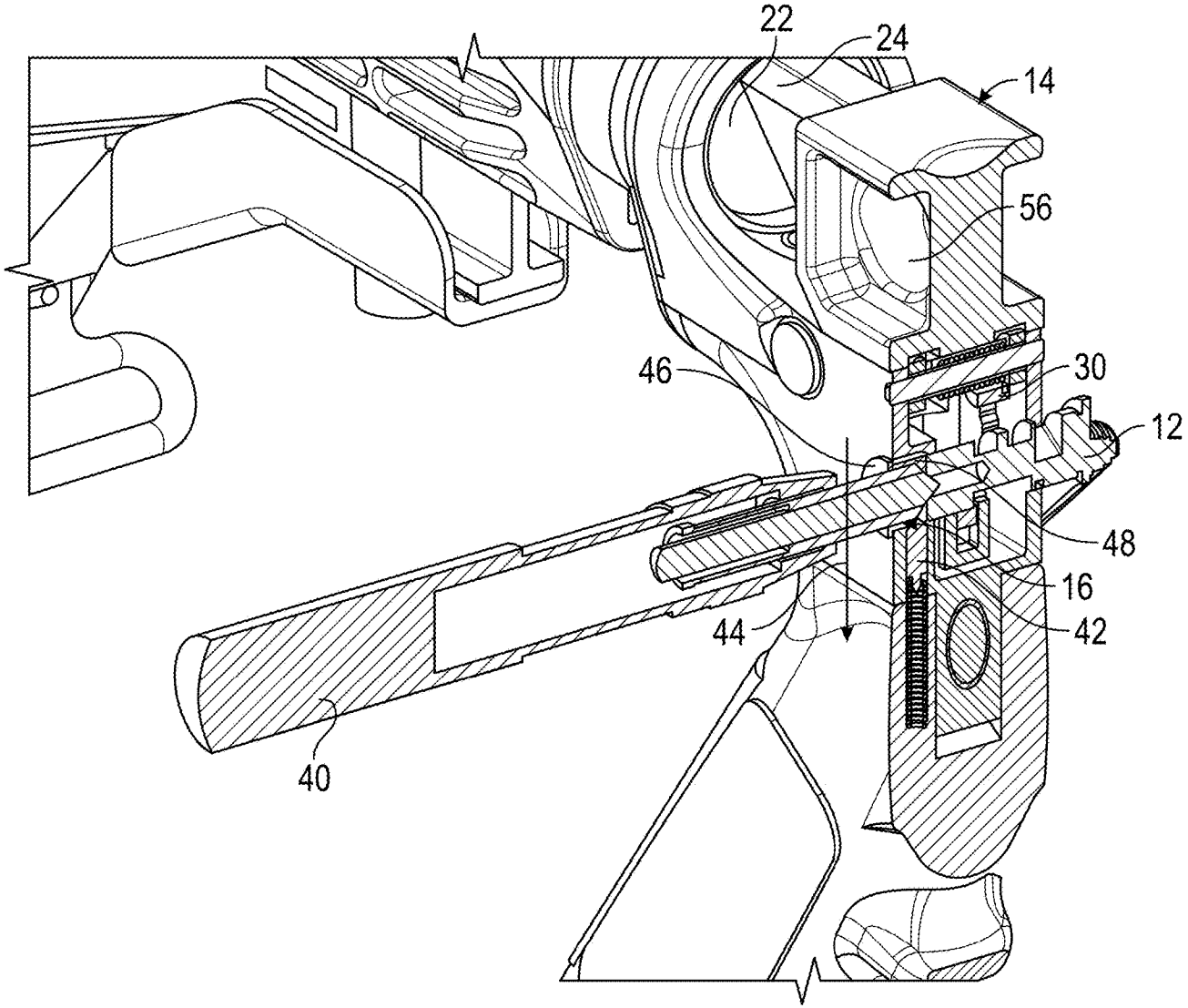
FIG. 10 is a cross-sectional view of a lower receiver of a firearm with a sear spring and sear deflector block installed therein and a detent deflector button fully inserted into the lower received to remove the selector switch.

Once this occurs and referring now to FIGS. 5 and 6, the selector switch is turned approximately to 45 degrees between safe and semi. At this point and as illustrated in FIGS. 7-10, the detent deflector button 16 is inserted into the lower receiver 10 in the direction of arrow 38 to remove the selector switch 12. This may be achieved in one non-limiting embodiment by a modified Starrett 819 center punch 40 or any suitable tool or center punch 40. In one embodiment and by turning the selector 12 to approximately 45 degrees is to get a spring biased detent 42 out of deeper positioning points at the safe, semi and auto positions and into a shallower groove/track that the detent 42 rides in as the selector 12 is turned. When the detent nose is in the shallower track this allows the impact of the center punch 40 to deflect/depress the detent 42 and get the selector 12 out. If the selector 12 is at the safe, semi or auto positions the detent 42 is too engaged to be moved. If the detent 42 is in the track anywhere between those positions it should be able to be removed with the tool 40. In other embodiments, the selector switch 12 may not need to be turned to 45 degrees between safe and semi in order to be removed from the lower receiver 12.

As the detent deflector button 16 is fully inserted into the lower receiver 10 in the direction of arrow 38, portions of the detent deflector button 16 will cause the spring biased detent 42 to be depressed in the direction of arrow 44 so that it no longer engages the selector switch 12. As such, the selector switch 12 can be pulled out of the lower receiver in the direction of arrow 38. In addition, a flange portion 46 of the detent deflector button 16 will engage the sides of the lower receiver 10 such that the detent deflector button 16 cannot continue to pass into an opening 48 the selector switch 12 is received in.

As previously mentioned, the selector 12 is capable of being removed due to the hook portion 30 and end portion 32 of the sear spring and sear deflector block 14 engaging the sear 34 and the portion 36 of a sear spring such that biasing force of the buffer spring 26 causes the sear 34 and a portion 36 of a sear spring to be disengaged from the selector switch 12.

Figure 11:
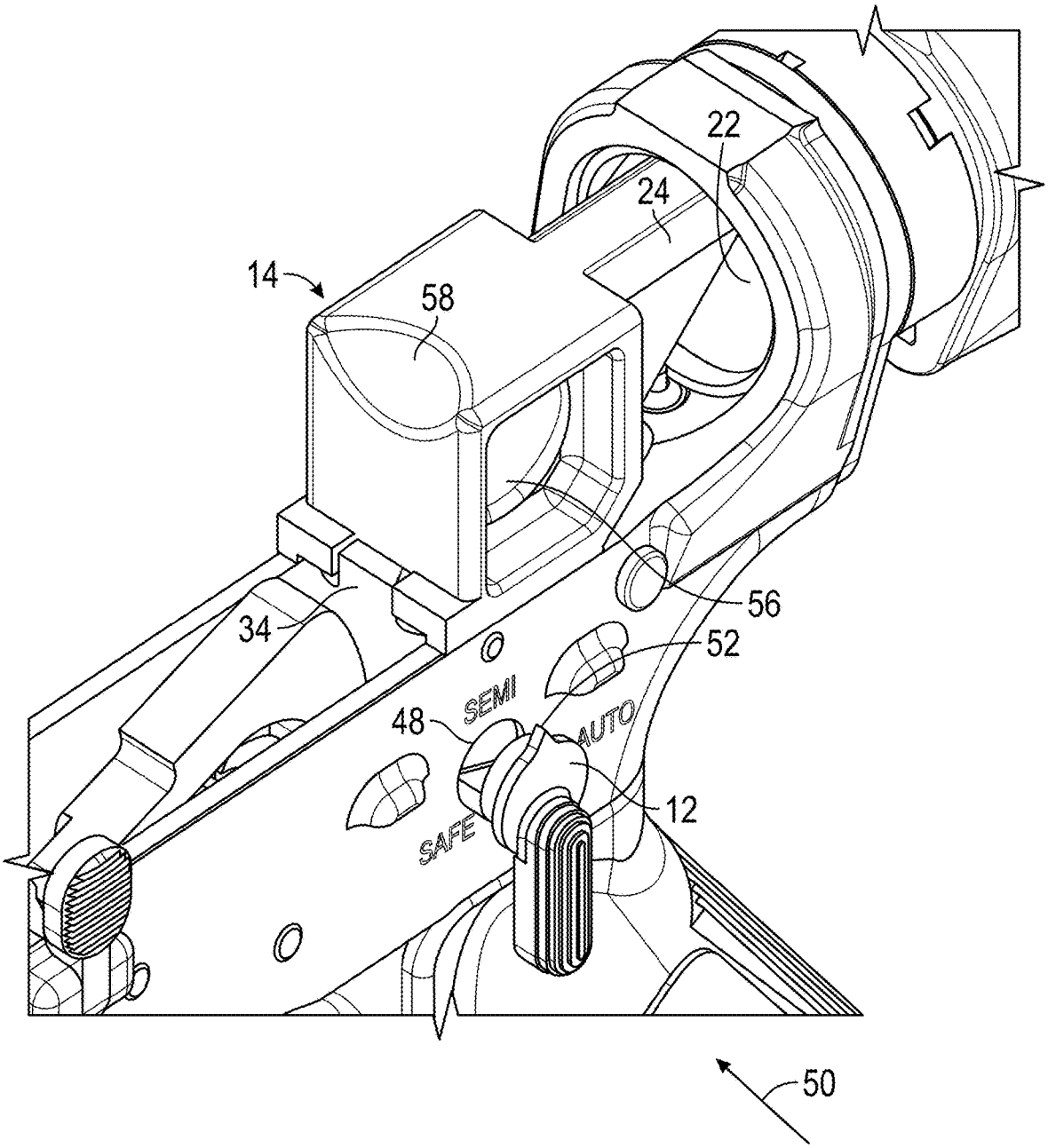
FIG. 11 is a perspective view of a lower receiver of a firearm with a sear spring and sear deflector block installed therein and a replacement selector switch being inserted therein.
Figure 12:
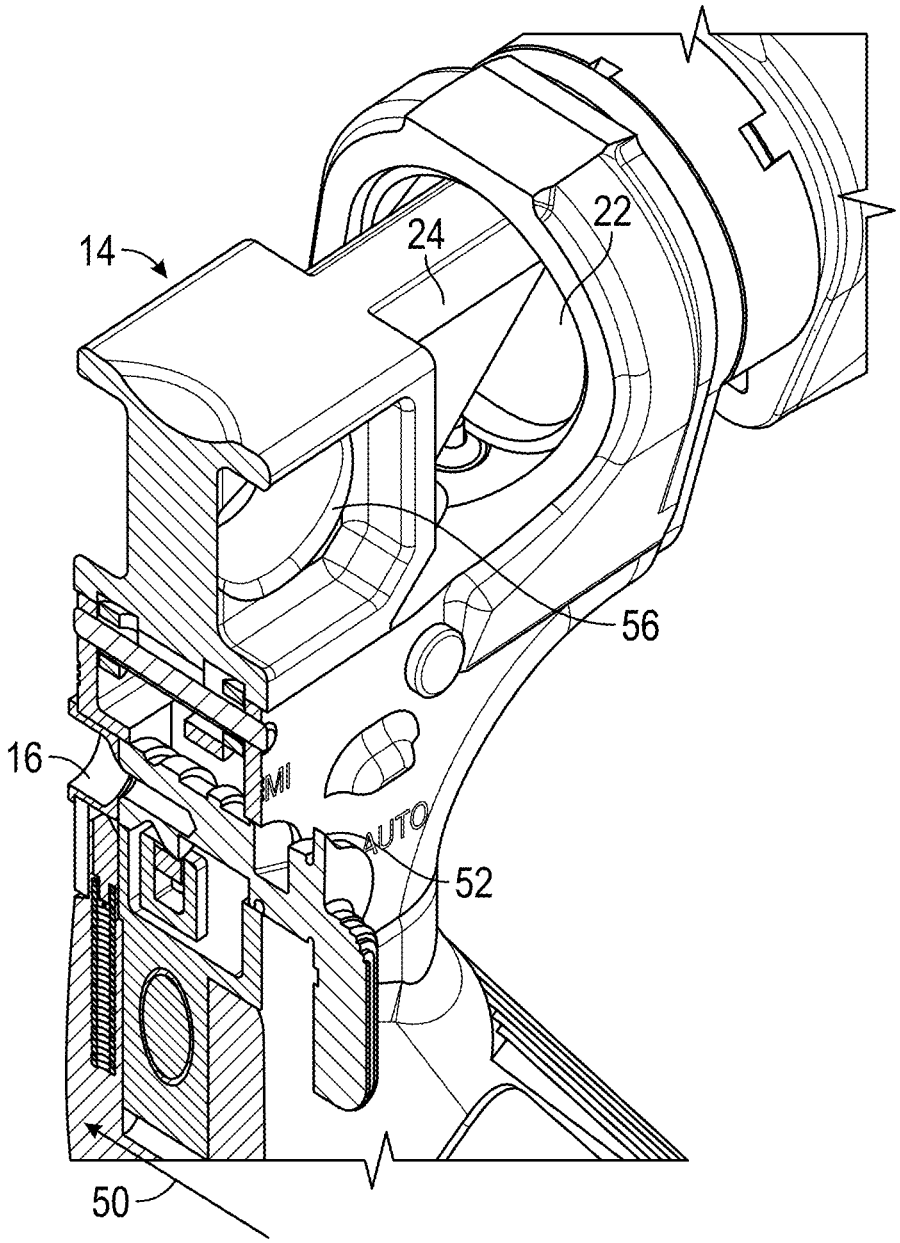
FIG. 12 is a cross-sectional view of a lower receiver of a firearm with a sear spring and sear deflector block installed therein and a replacement selector switch being inserted therein.
Figure 13:
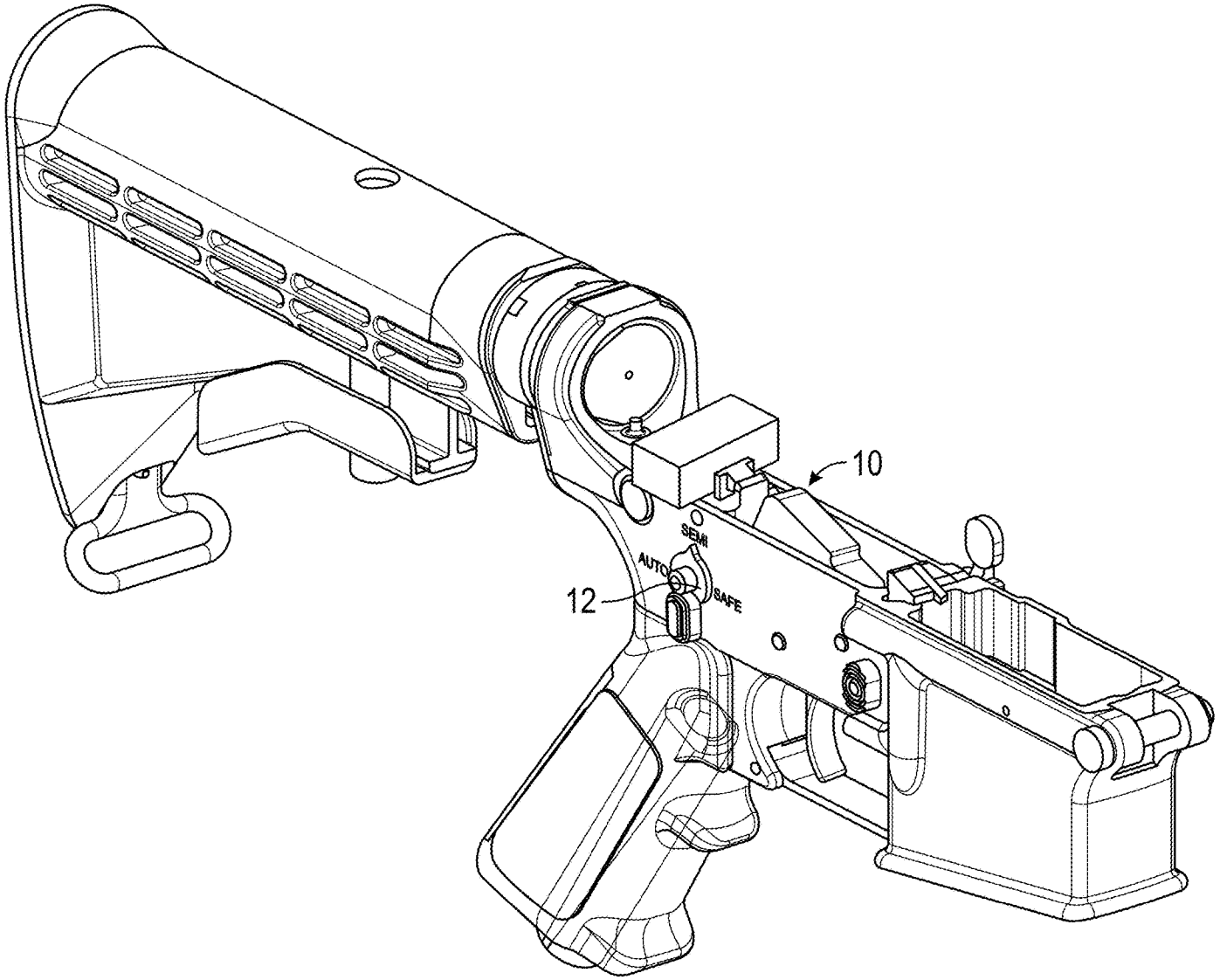
FIG. 13 is a perspective view of a lower receiver of a firearm.
Figure 14:
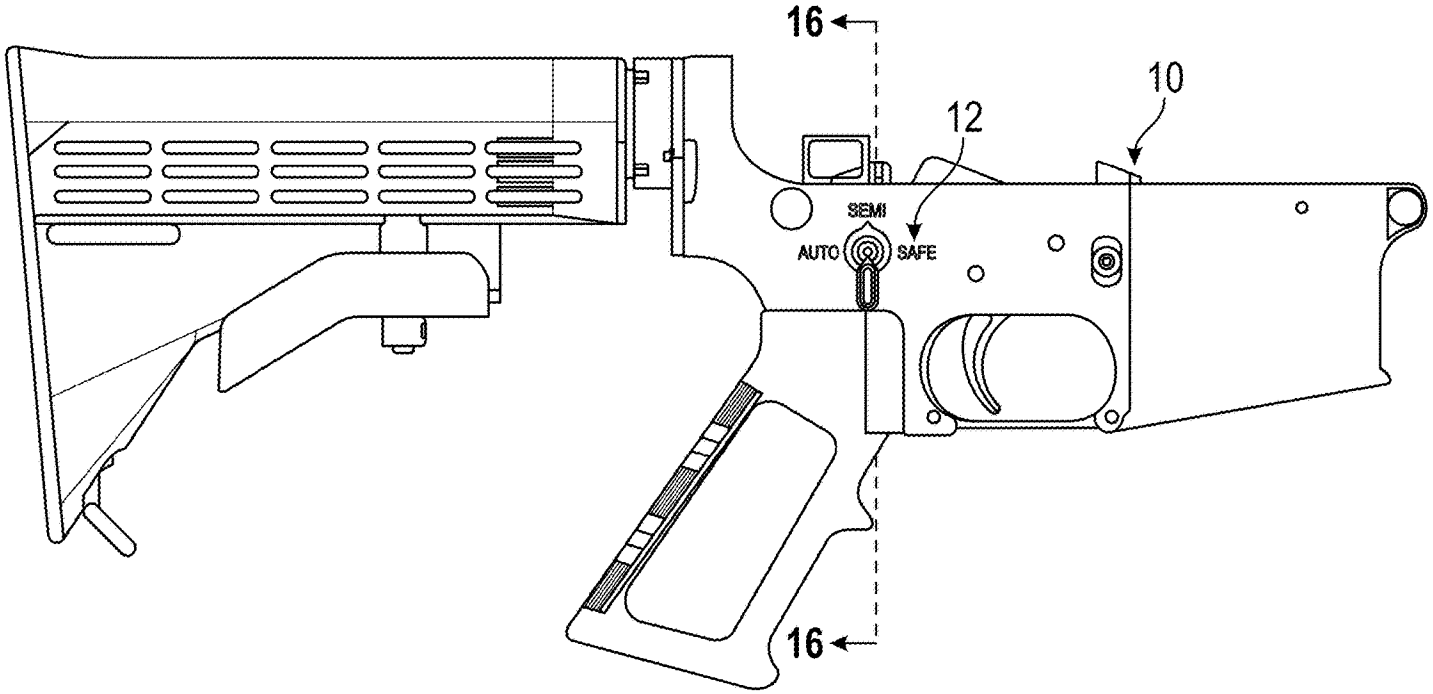
FIG. 14 is a side view of a lower receiver of a firearm.
Figure 15:
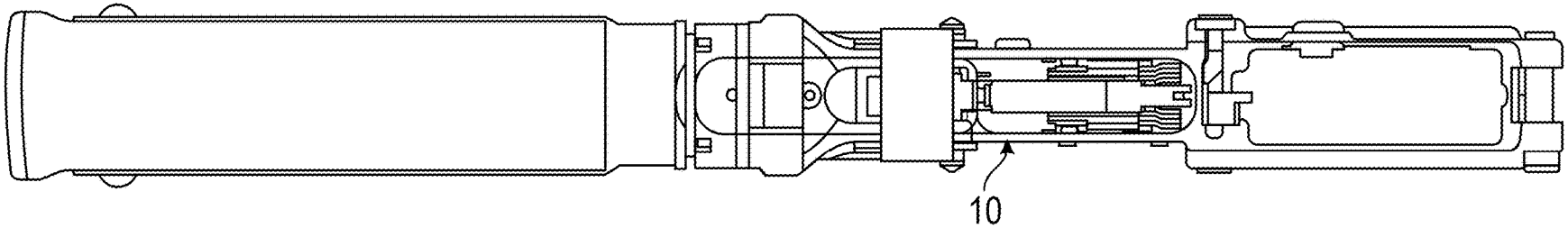
FIG. 15 is a top view of a lower receiver of a firearm.
Figure 16:
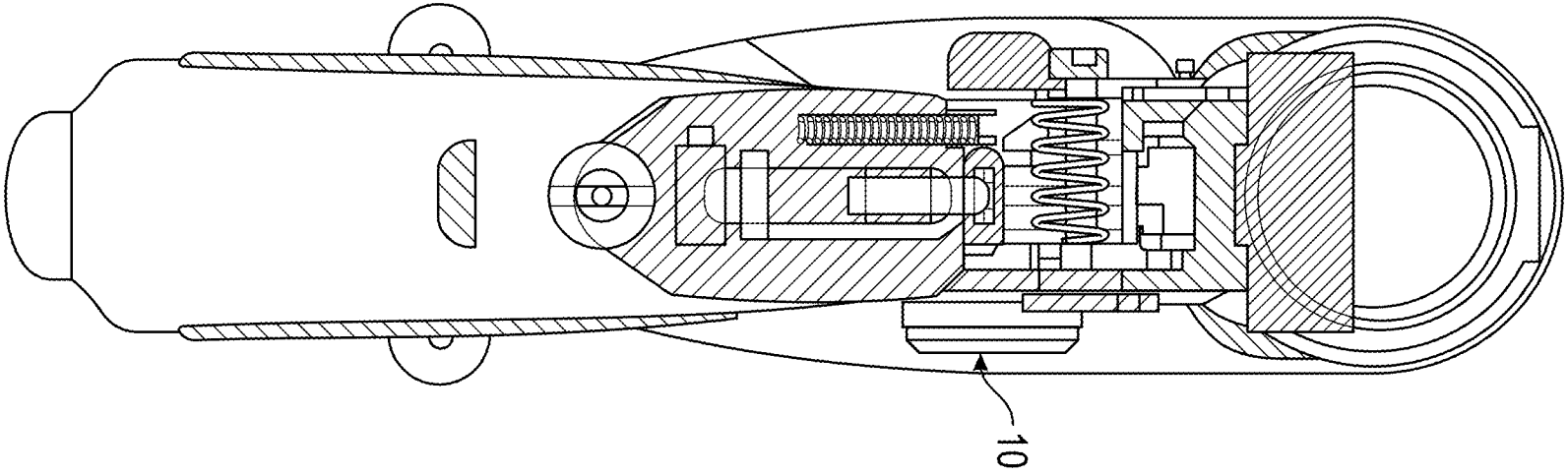
FIG. 16 is a cross-sectional view along lines C-C of FIG. 14.

Once the selector 12 is removed it can be replaced with a new selector 12. This is illustrated in at least FIGS. 11-12 wherein the new selector 12 is inserted into opening 48 in the direction of arrow 50 with its selector point 52 pointing toward semi. This is achieved by pushing the selector firmly in the direction of arrow 50 with constant pressure, which in turn pushes the detent deflector button 16 out of the opposite side. At this point a new ancillary lever 18 and socket cap or screw 20 are installed to complete the assembly. In other embodiments, the selector point 52 of the selector switch 12 may not need to point to semi in order for it to be installed in the lower receiver 12. Thereafter, the sear spring and sear deflector block 14 is removed so that the sear 34 and the portion 36 of the sear spring 36 can engage the newly installed selector switch 12. This is achieved by the reverse process by pushing the sear spring and sear deflector block 14 in the direction of arrow 28 so that the buffer moves into the buffer extension 54 and then the sear spring and sear deflector block 14 is removed.

Figure 17A:
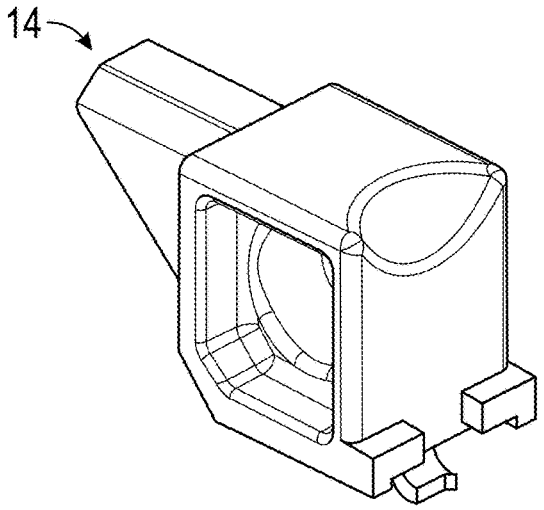
FIG. 17A is a perspective view of a sear spring and sear deflector block.
Figure 17B:
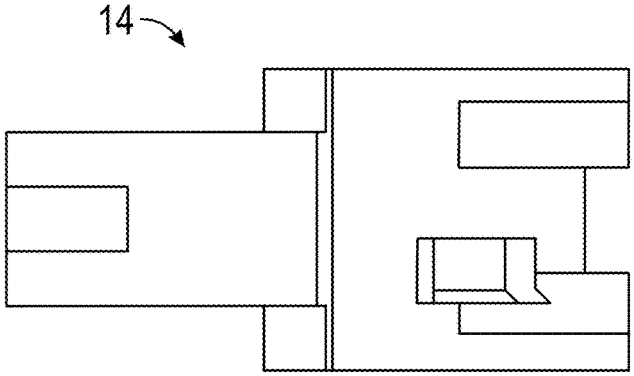
FIG. 17B is a bottom view of a sear spring and sear deflector block.
Figure 17C:
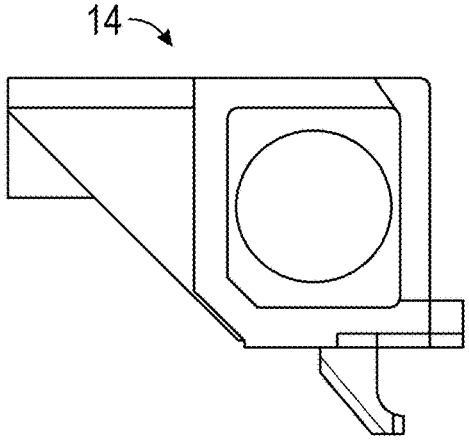
FIG. 17C is a side view of a sear spring and sear deflector block.
Figure 18:
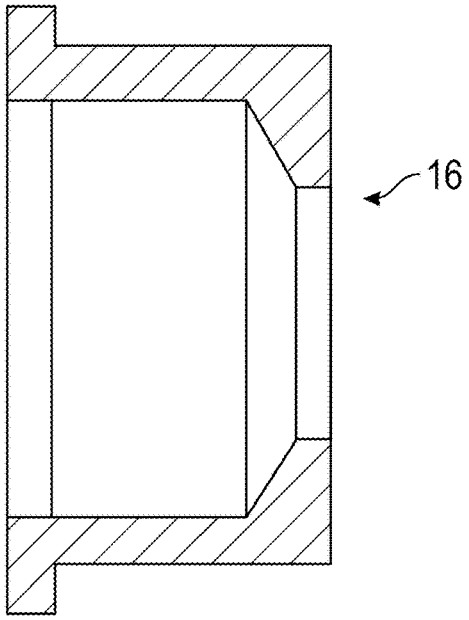
FIG. 18 is a cross-sectional view of a detent deflector button.
Figure 19A:
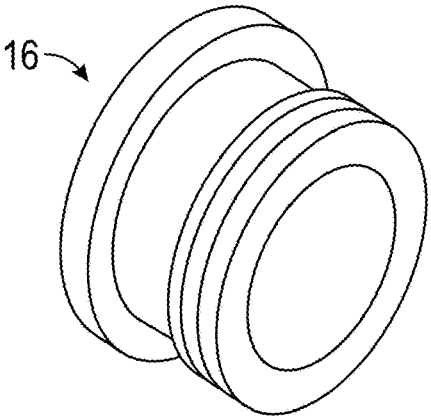
FIG. 19A is a perspective view a detent deflector button.
Figure 19B:
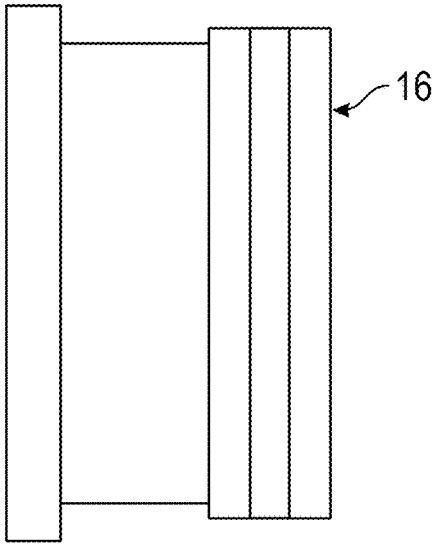
FIG. 19B is a side view a detent deflector button.
Figure 20:
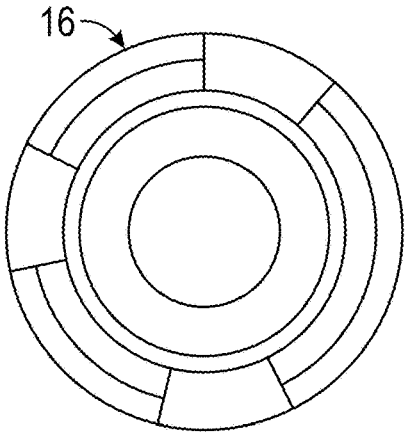
FIG. 20 is an end view a detent deflector button.
Figure 21A:
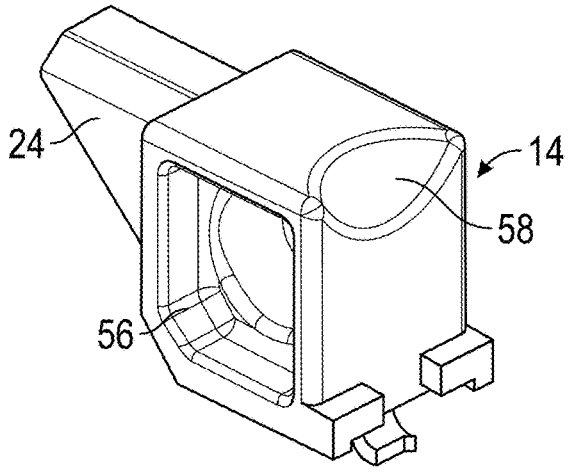
FIG. 21A is a perspective view of a sear spring and sear deflector block.
Figure 21B:
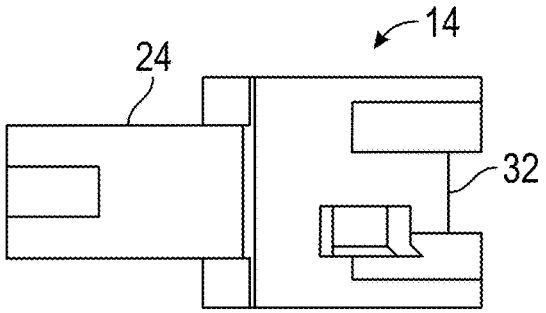
FIG. 21B is a bottom view of a sear spring and sear deflector block.
Figure 21C:
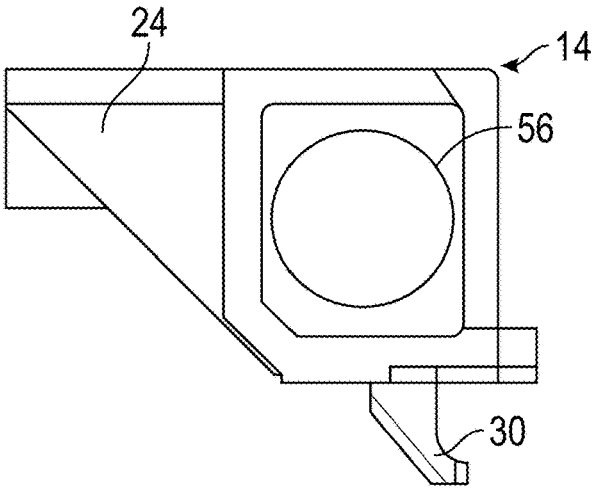
FIG. 21C is a side view of a sear spring and sear deflector block.

FIGS. 13-16 are various views of a lower receiver and FIGS. 17A-17C are various view of a sear spring and sear deflector block 12 in accordance with one non-limiting embodiment of the present disclosure. FIG. 18-FIG. 20 are various views of the detent deflector button 16 in accordance with one non-limiting embodiment of the present disclosure. FIGS. 21A-21C are various view of a sear spring and sear deflector block 12 in accordance with one non-limiting embodiment of the present disclosure.

In one embodiment, the sear spring and sear deflector block 14 may have an opening 56 that allows a user to easily grasp the sear spring and sear deflector block 14. In addition and in yet another embodiment either alone or in combination with opening 56. The sear spring and sear deflector block 16 may have a recessed area 58 that provides a surface for a user to engage while they are pressing the sear spring and sear deflector block 14 towards and partially into the buffer extension 54.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method of replacing a selector switch of lower receiver of a firearm, comprising:

removing an ancillary portion of the selector switch;

inserting a sear spring and sear deflector block into the lower receiver such that a hook portion and an end portion of the sear spring engage a sear and a portion of a sear spring to cause the sear and the portion of a sear spring to be disengaged from the selector switch;

inserting a detent deflector button into a side of the lower receiver such a spring biased detent is depressed and the selector switch extends from an opposite side of the lower receiver;

removing the selector switch;

inserting a new selector switch into the opposite side of the lower receiver such that the detent deflector button is dislodged from the side of the lower receiver;

removing the sear spring and sear deflector block; and securing the ancillary portion or a new ancillary portion to the new selector switch.

2. A kit for replacing a selector switch of a lower receiver of a firearm, comprising:

a sear spring and sear deflector block having a hook portion for engaging a portion of a sear spring when the sear spring and sear deflector block is secured to the lower receiver and an end portion for engaging a sear of the lower receiver when the sear spring and sear deflector block is secured to the lower receiver, the sear spring and sear deflector block further comprising a protrusion for engaging a buffer spring of the lower receiver when the sear spring and sear deflector block is secured to the lower receiver; and a detent deflector button for depressing a detent of the lower receiver when detent deflector button is inserted into an opening of the lower receiver configured to receive the selector switch.

3. A sear spring and sear deflector block for replacing a selector switch of a lower receiver of a firearm, the sear spring and sear deflector block having a hook portion for engaging a portion of a sear spring when the sear spring and sear deflector block is secured to the lower receiver and an end portion for engaging a sear of the lower receiver when the sear spring and sear deflector block is secured to the lower receiver, the sear spring and sear deflector block further comprising a protrusion for engaging a buffer spring of the lower receiver when the sear spring and sear deflector block is secured to the lower receiver.

* * * * *